US005247892A

United States Patent [19]

Svensson

[11] Patent Number: 5,247,892

[45] Date of Patent: Sep. 28, 1993

[54] FURNACE FOR SOLID FUELS

[76] Inventor: Erik Svensson, S53496, PL7215 Ryda, Sweden

[21] Appl. No.: 689,811

[22] PCT Filed: Nov. 8, 1989

[86] PCT No.: PCT/SE89/00637

§ 371 Date: May 8, 1991

§ 102(e) Date: May 8, 1991

[87] PCT Pub. No.: WO90/05269

PCT Pub. Date: May 17, 1990

[30] Foreign Application Priority Data

Nov. 8, 1988 [SE] Sweden ..... 8804032

[51] Int. Cl.[5] ..... F23L 1/00

[52] U.S. Cl. ..... 110/248; 110/315; 110/316

[58] Field of Search ..... 110/315, 316, 229, 248

[56] References Cited

U.S. PATENT DOCUMENTS

| | | | |
|---|---|---|---|
| 2,337,053 | 12/1943 | Langley | 110/315 |
| 4,441,436 | 4/1984 | Hayashi | 110/315 |
| 4,471,702 | 9/1984 | McKinlay | 110/315 |
| 4,479,481 | 10/1984 | Ingersoll et al. | 110/315 |
| 4,771,711 | 9/1988 | Pike | 110/315 |

FOREIGN PATENT DOCUMENTS

| | | |
|---|---|---|
| 0084852 | 8/1983 | European Pat. Off. . |
| 0168808 | 1/1986 | European Pat. Off. . |
| 2516209 | 5/1983 | France . |
| 2583148 | 12/1986 | France . |
| 2583503 | 12/1986 | France . |
| 2592944 | 7/1987 | France . |

*Primary Examiner*—Henry C. Yuen
*Attorney, Agent, or Firm*—Dovorak and Traub

[57] ABSTRACT

The invention concerns a furnace for biological fuels in which the combustion is effected downwards in order to allow firing down to very low output effect. In accordance with the invention the furnace has a fuel storage vessel (1) which also serves as a gas collection vessel and which during operation is pressurized to a slight atmospheric overpressure. The bottom part of the storage vessel is formed with sloping walls (4) the lower edges of which form a burner opening and above which opening is provided a draft-air supply means which extends closely alongside the sloping bottom along the portions thereof positioned closest to the burner opening.

11 Claims, 3 Drawing Sheets

FURNACE FOR SOLID FUELS

The present invention concerns a furnace for biological fuels, i.e. a device for combustion of solid fuels.

More specifically, the invention concerns a furnace for biological fuels, comprising a fuel storage vessel which is closable at its upper portion, a fuel-feed lid at the upper portion of the furnace, and an exhaust gas opening at the bottom of the fuel storage vessel in order to create downwardly directed combustion.

A problem encounted in previously known constructions of the type outlined above is that when the heat extraction is low they emit fumes which are unacceptable from an environmental point of view. In addition, their combustive efficiency is low. This is due e.g. to the fact that it is not possible to control and mix the gas that develops and the air that is supplied for oxygenation purposes in the correct proportions. In addition, furnaces of this kind often are manufactured to operate at a high maximum effect, approximatively 2–3 times the required thermal energy extraction, with the result that they must be fired in batches, with resulting increase of work and efficiency losses.

The main purpose of the subject invention is to eliminate these problems. This is achieved in a furnace in accordance with the invention which is essentially characterized in that the bottom of the fuel storage vessel slopes towards the exhaust-gas opening at an angle which is larger than the angle of repose of the combustion material, in that said exhaust-gas opening which also serves as the burner opening is covered by a draft-air supply means which along a part of its outer periphery extends closely alongside the part of the sloping bottom of the fuel storage vessel that is closest to the burner opening, and in that said draft-air supply means further comprises both downwardly directed draft-air channels which open into the gap formed between the draft-air supply means and the fuel storage vessel bottom, and laterally directed upper draft-air channels, an adjustable supply air fan being provided upstreams of the draft-air supply means.

Figure 2:
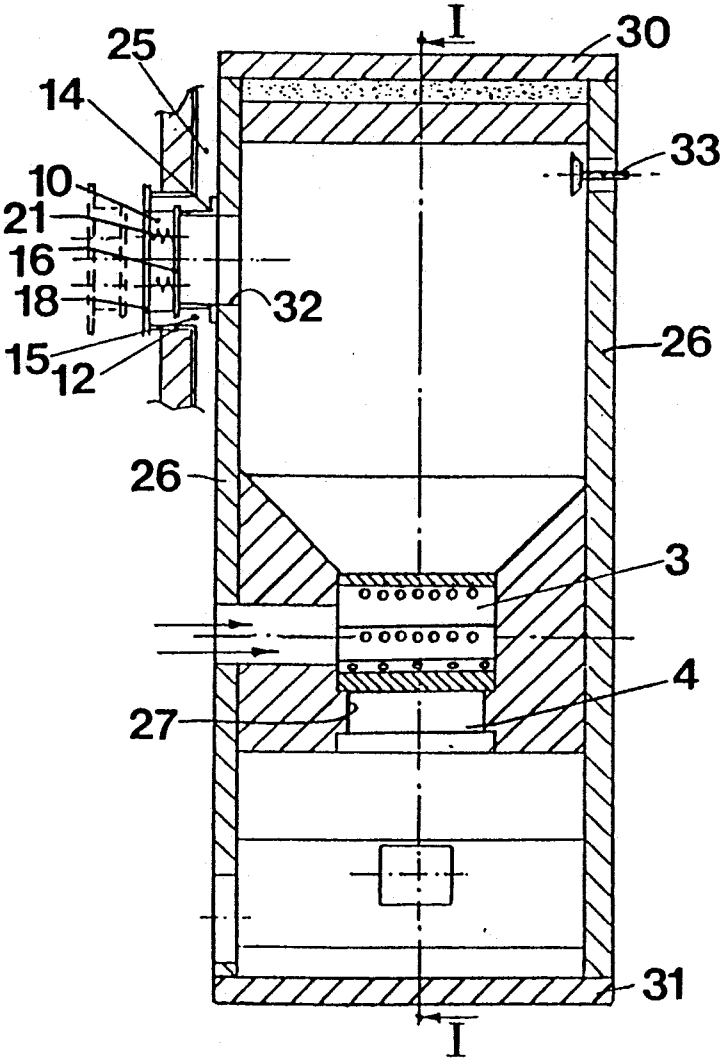
Figure 1:
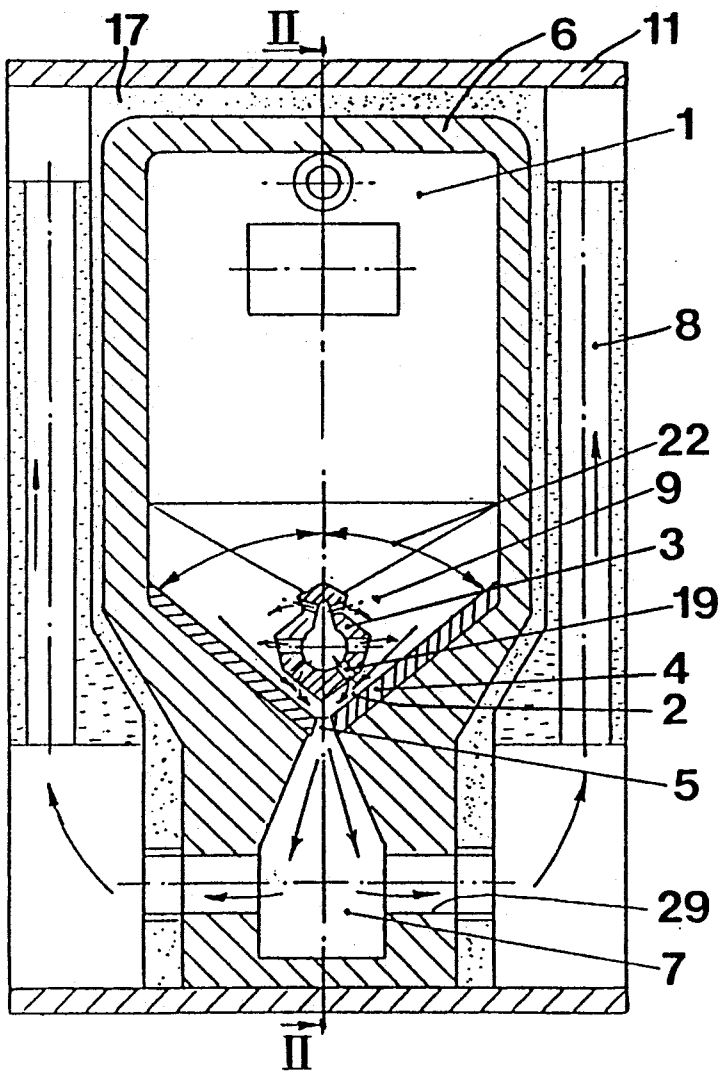
Figure 4:
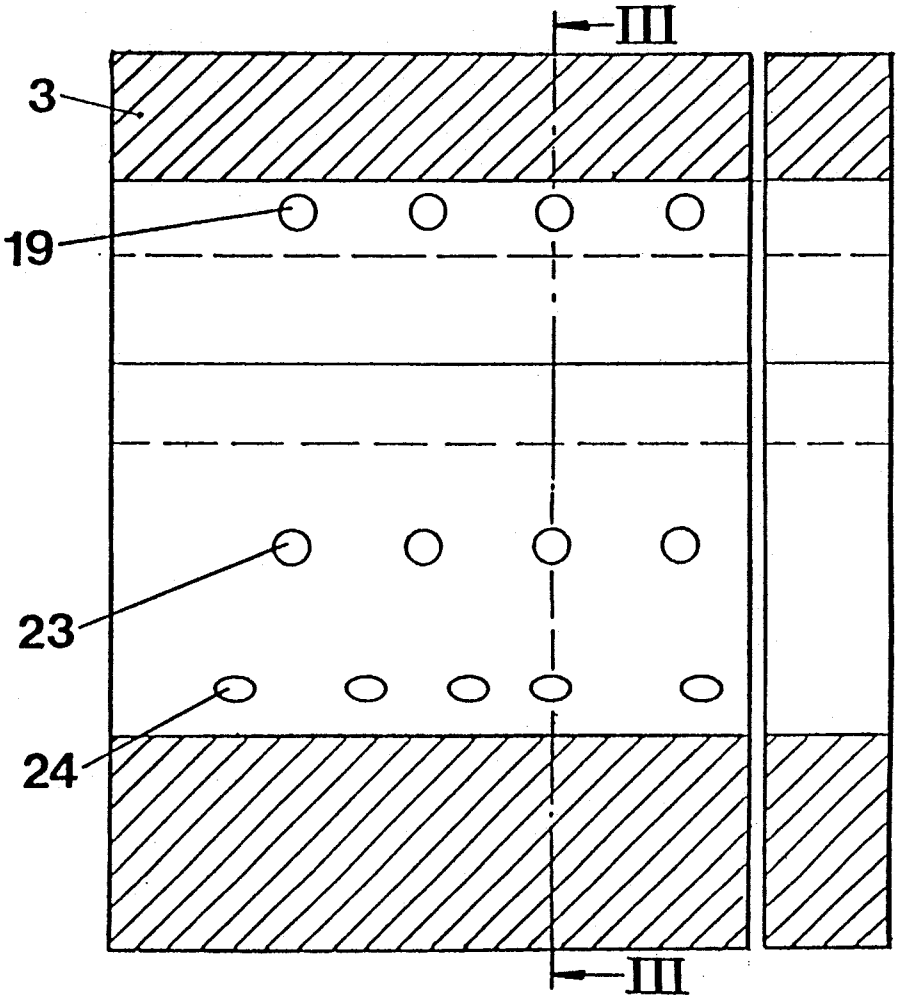
Figure 3:
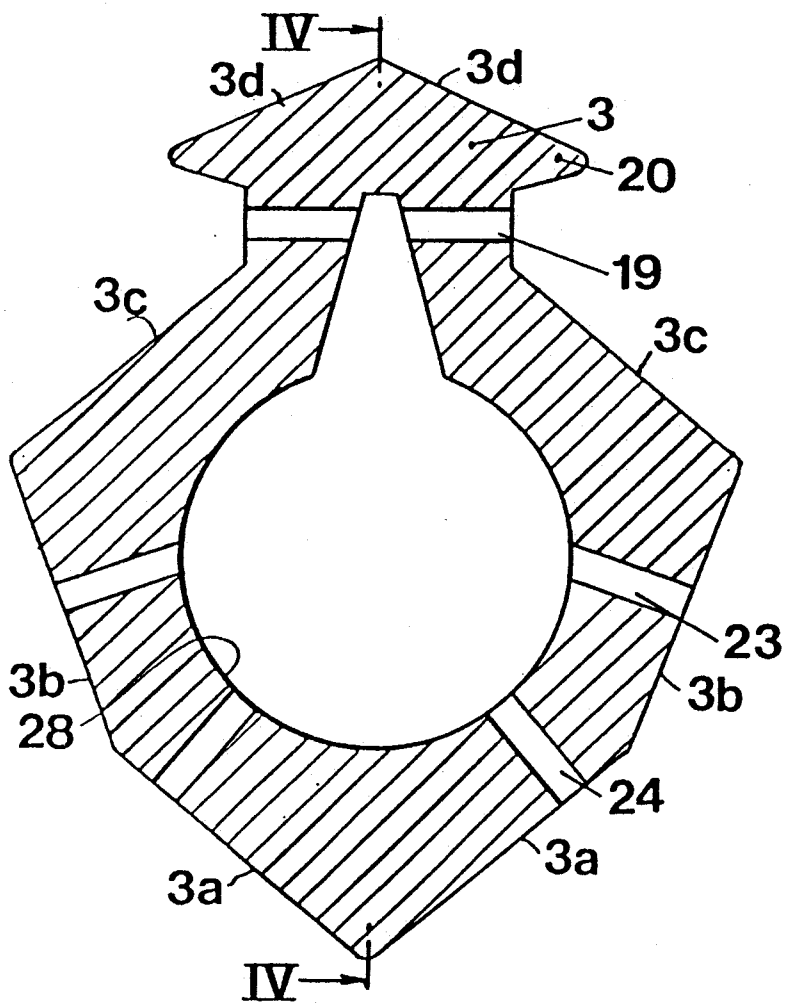
Figure 5:
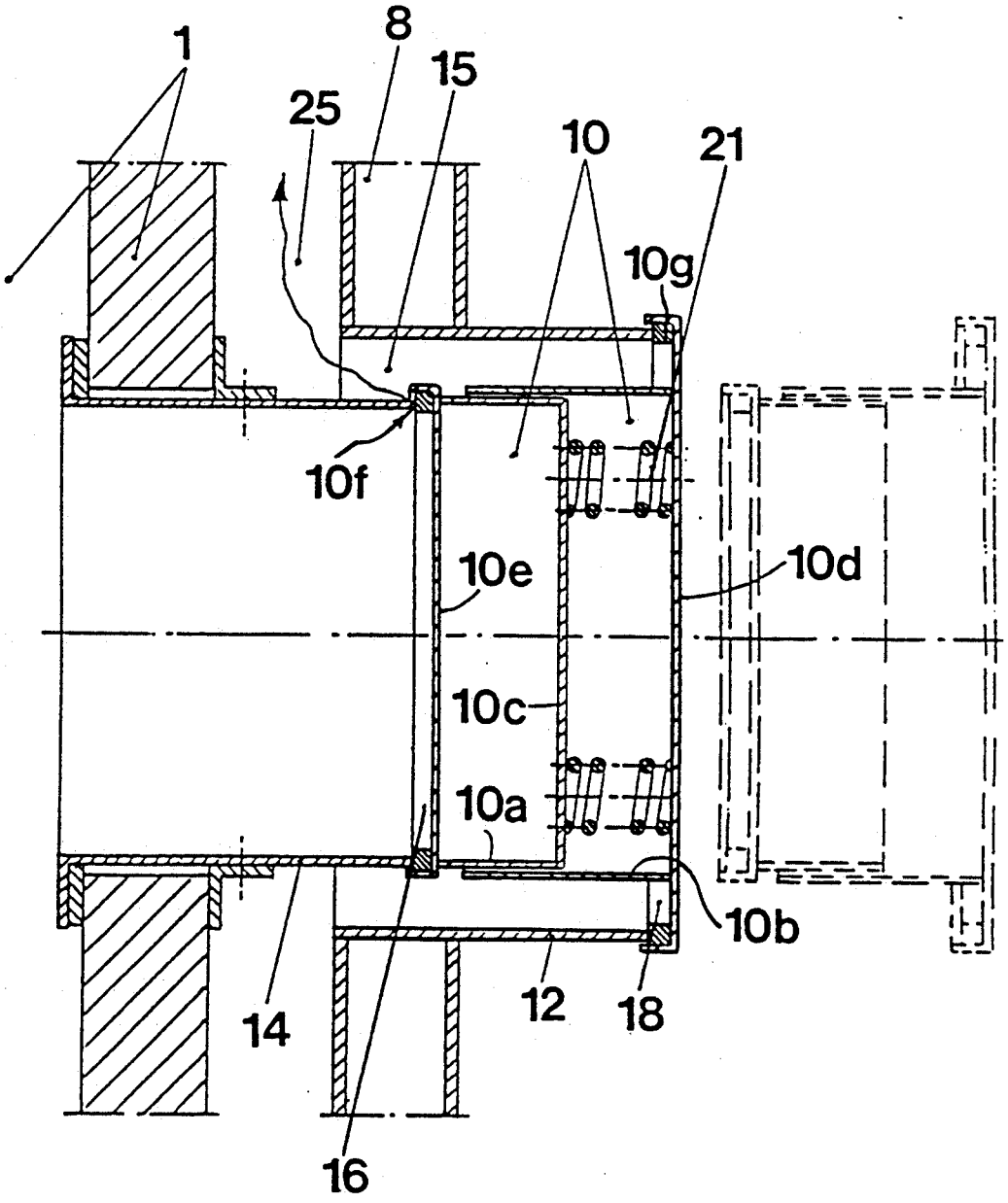

One embodiment of the invention will be described in closer detail in the following with reference to the accompanying drawings, wherein FIG. 1 is a central sectional view along line I—I in FIG. 2 through a furnace in accordance with the invention, FIG. 2 is a corresponding central cross-sectional view along line II—II in FIG. 1 through the lower furnace part, the outer furnace parts having been removed, FIG. 3 is a sectional view along line I—I in FIG. 2 and line III—III in FIG. 4 through the draft-air supply means, FIG. 4 is a sectional view along line II—II in FIG. 1 and line IV—IV in FIG. 3 through the same draft-air supply means, and FIG. 5 illustrates on an enlarged scale a vertical sectional view through the fuel-feed lid and adjoining parts of the fuel supply opening of the furnace.

The furnace illustrated in the drawing comprises an interior part which is designated generally by numeral 6 and which is made from a heat-resistant material, such as ceramics, and an exterior part 11 enclosing the interior part and containing an exhaust channel system which, together with the water jacket 13 surrounding the exhaust channel system forms a heat-exchange system for extraction of thermal energy from the furnace. Between the interior part 6 and the exterior part 11 is arranged a layer 17 of insulating material. In accordance with the embodiment illustrated, the interior part 6 comprises two moulded sections which are partitioned along plane II-II in FIG. 1. Preferably, these two halves are of symmetrical configuration, having an upper cavity portion 1 forming the fuel storage vessel, and a lower cavity part 7 forming the combustion chamber.

At its lower part the fuel storage vessel presents a sloping bottom which is covered by preferably removable bottom slabs 4, which likewise preferably consist of a ceramics or any other heat-resistant material. The inclination angle of the bottom slabs 4 preferably is equal to or larger than the angle of repose of the fuel material and the opposite edges of the slabs are spaced mutually apart so that a gap is formed between them. The gap serves as an exhaust-gas opening 5 which in the subject case also serves as the burner opening. The ends of part 6 which are turned towards each other are covered by end wall slabs **26*a* and 26*b*** which preferably also are made of ceramics or some other heat-resistant material.

Centrally inside the bottom part of the fuel storage vessel the interior part 6 is formed with a pocket 27 into which is inserted a draft-air supply means, the latter likewise being made from a heat-resistant material, preferably ceramics. In accordance with the embodiment illustrated in the drawings the draft-air supply means 3, which preferably is removable, has an essentially parallelepiped configuration and covers the burner opening 5 as well as the adjoining portions of the sloping bottom slabs or plane 4. The lower faces **3*a* of the draft-air supply means extend closely alongside the bottom planes 4 whereby a comparatively small gap 2 is formed between the faces 3*a* and the planes. A number of draft-air bores 24 communicating the interior draft-air channel 28 of the draft-air supply means with the gap 2, open in the lower faces 3*a*. A number of additional draft-air bores 23 also open above the gap 2 and, at a yet higher level, open further draft-air bores 19. Consequently, all draft-air bores form air-intake openings. As is most clearly apparent from FIG. 3** some portions of the draft-air supply means are positioned above all air intake openings so as to efficiently prevent any combustion material which may fall from the fuel storage vessel from obstructing the air-intake openings.

In accordance with the shown embodiment the draft-air supply means has a parallelepiped configuration. This is a preferable configuration but obviously the invention is not restricted to this shape.

Because the faces **3*a* of the draft-air supply means as well as the faces 3*b* thereabove are turned downwards these faces as such form the portions covering the associated openings. The upper air-intake openings 19 are covered by separate eaves-like projections 20. The faces 3*c* and 3*d*** which are turned upwards are inclined at an angle which preferably could be larger than the angle of repose of the combustion material, thus preventing material from collecting on top of the draft-air supply means.

In accordance with the embodiment shown, the faces **3*a* of the draft air supply means are essentially parallel with the sloping planes 4 but obviously it is within the scope of the invention to vary the spacing somewhat between the sloping planes and the draft-air supply means, should this be required in view of particular fuels or the heat extraction from the furnace. The combustion chamber 7 likewise communicates with the exhaust-gas channel system 8 via connection channels 29**.

At its upper part the furnace is covered by a top slab 30 and at its base it is supported on a bottom slab 31. In FIG. 2 only a part of the jacket system of the furnace is illustrated, more precisely the part surrounding the fuel supply opening 32 which may be closed by means of a fuel-feed lid 10. The fuel-feed opening 32 is surrounded by a flange 14 forming an inner sealing edge against the fuel-feed lid. The jacket system of the furnace also has an outer flange 12, forming an outer sealing edge against the lid. Between the interior portion of the furnace and the outer jacket system thereof there is a gap 25 in communication with the furnace exhaust-gas channel system.

The construction of the fuel-feed lid is clearly apparent from FIG. 5, wherein the closed position of the lid is illustrated in continuous lines and its open position in discontinuous lines. The fuel-feed lid consists of two telescopically movable portions 10*a* and 10*b*. These two lid portions are in the form of tube sections which are nested one in the other and which have one end wall each, 10*c* and 10*d*, respectively. A number of compression springs 21 are held between these end walls. The inner portion is provided with a lid plate 10*e*. By means of a packing 10*f* the lid plate 10*e* seals against the inner flange 14 and by means of a packing 10*g* the end wall 10*d* seals against the outer flange 12, as mentioned previously. Owing to the mutual movability of the two lids portions the latter provide an efficient seal against their associated flange, also in case the spacing between the end edges of the flanges should vary for some reason. To close the lid the inner flange 14 is moved first and the outer flange 12 thereafter to the closed positions. Also in the closed position of the lid the space 15 surrounding the lid maintains communication with the exhaust-gas canal system 25 of the furnace. The lid plane formed by the lid end wall 10*d* is designated by reference 18 on the drawings and the lid plane formed by the lid end wall 10*e* is designated by 16.

By numeral references 33 is designated a valve by means of which the upper part of the fuel storage vessel may communicate with the exhaust gas channel system of the furnace. This may be the case when the furnace operation is initiated. However, valve 33 preferably is maintained in closed position when the furnace is in operation.

In operation of the furnace, biological fuel present in the fuel storage vessel 1 is pyrolysed so as to form a gas which is formed downwards by its low atmospheric overpressure through the burner opening 5 while being combusted and at the same time pre-heated air is being supplied from the draft-air supply means 3. The fuel storage vessel 1, the combustion zone 9, the draft-air supply tube 3, the sloping planes 4 and the secondary combustion chamber 7 together with the ashes-collection cavity pertaining thereto all preferably are made from a ceramics material as mentioned in the aforegoing. The exhaust gases preferably are transported inside air gap 25 surrounding the ceramics part. The draft tube placed over the burner opening 5 is located in the hot combustion zone and consequently it will be heated to a high temperature. The draft-air which is supplied by means of a preferably adjustable fan, not shown in the drawings, and which passes through the various openings 19, 23, 24 in the draft-air supply means 3 is preheated before participating in the combustion process. The position of the draft-air supply tube and its configuration including air diffusing apertures provide an ejecting effect which in the case of varying heat-extraction ensures the correct mixture of generated gas and supplied draft-air. Because of the inwardly directed openings in the draft tube 3 for the draft-air, turbulent combustion is created.

Part of the heat generated during the combustion finds it way upwards inside the fuel storage vessel, whereby the fuel is pyrolysed and gas is produced. Also when the heat-extraction is low the heat inside the combustion zone 9 is sufficient to generate gases to an adequate degree. The combustion of gas travelling downwards essentially is the form of combustion of aldehyde. Aldehyde combustion oxidizes hydrocarbons by way of aldehyde into $CO_2$ and $H_2O$. Aldehyde combustion generates the cleanest exhaust gases.

The portion of the fuel storage vessel that is positioned above the combustion zone 9 forms an upwardly closed vessel in the course of the process, provided that the valve 33 is closed, and consequently gas can only be emitted downwards through the burner opening 5. In the course of the combustion process the fuel storage simultaneously forms a gas bell, wherein generated gas accumulates at a slight overpressure relatively to the surrounding atmosphere prior to its combustion and wherein the gas in the upper part of the fuel storage vessel will not be combustible on account of the poor oxygenation. When gas is generated from the fuel the volume of the gas increases and as a result a slight overpressure is formed in the fuel storage vessel. This pressure combines with the pressure of the draft-air supply fan so as to pressurize the fuel storage vessel as required in order to force the gas downwards. Because the fuel storage vessel is pressurized it needs to be sealed. This requirement is met in that, as mentioned before, the fuel-feed lid is formed with double lid walls, each one having a sealing function. Any gas that may pass the sealing of the inner lid is sucked out through the fume exhaust. Owing to this arrangemnet, poisonous gases do not end up in the environment. During refuel, when the fuel-feed lid is open, fumes are prevented from seeping out into the environment, because these gases are evacuated by way of the free space 25 between the inner and outer seals and are transferred further to the fume exhaust of the furnace.

When the process has progressed to the point where no more gas is generated, charcoal remains, if wood has been used as fuel. This charcoal is consumed continuously as draft-air is being supplied. The combustion of the charcoal takes place in two steps, first $2C^2+O^2=-2CO+$heat, thereafter after $2CO+O^2+$heat At this stage of the process, new fuel is supplied if the heating is to continue. The biological-fuel furnace preferably operates continuously, and the heat extraction could be varied in accordance with the rotational speed of the fan supplying air to the draft-air supply means 3 from low extraction to high extraction, while maintaining purity of combustion and a high degree of efficiency. Owing to the angle of inclination 22 of the bottom part of the fuel storage vessel the fuel material is efficiently urged to collapse downwards. This material could be charcoal and ashes. The sloping bottom part also forms a burner opening the dimensions of which can easily be adjusted to the capacity desired for the device. The sloping planes which are made from a heat resistant material, preferably a ceramics material, and which are replaceable, preferably are insulated from their support faces in order to retain the generated heat. This is of considerale importance to obtain good combustion results. The valve 33 provided in the fuel storage vessel 1 preferably is maintained in an open position during the starting-up stage, whereby the fumes will travel directly into the fume outlet. In this way the start-up is facilitated. During operation, this valve preferably is maintained in a closed position. The valve may also be opened while the device is being refueled, which contributes to preventing fumes from reaching the environment. Gas generated from the fuel storage vessel 1 is mixed with pre-heated air from the draft-air supply means 3 and is combusted downwards through the burner opening 5 into the secondary combustion chamber 7 underneath. This space also serves as an ashes collection chamber. After combustion, the hot gases flow from the secondary combustion chamber 7 to the heat exchanger 8, wherein the thermal energy is utilized in the customary way in the water jacket 13, whereupon the exhaust gases proceed upwards.

The invention is not limited to the example described in the aforegoing and illustrated in the drawings but could be varied as to its components and details within the scope of the appended claims without departing from the inventive idea. For instance, the invention is not limited to the arrangement of e.g. the combustion chamber. Naturally, this chamber could be made from other types of elements which could be assembled in any suitable way. Nor is the invention limited to the particular design and mounting of the draft-air supply means 3, the configuration and mounting of which may be varied, although the embodiment shown has been found to possess considerable advantages as concerns the service as well as the function of the furnace.

I claim:

1. A furnace comprising:

a pressurized fuel storage vessel;

an exhaust gas opening disposed at a lower portion of said fuel storage vessel having an inclined surface that slopes forward of aid exhaust gas opening;

a horizontal, parallelepiped-shaped draft air supply disposed within said fuel storage vessel along said inclined surface, proximate said exhaust gas opening, to form a gap between said draft air supply and said inclined surface, said draft air supply having draft air channels which open into said lower portion of said fuel storage vessel, said draft air supply having downwardly directed draft air channels which open into said gap and laterally directed air channels which open into said lower portion of said fuel storage vessel, said draft air supply having a portion projecting over said downward and said lateral draft air channels, a heat resistant hollow body, and surfaces which are turned upward and which slope toward said exhaust gas opening of said fuel storage vessel at an angle larger than the angle of repose of combustion material, and a secondary combustion chamber disposed below said fuel storage vessel, said secondary combustion chamber being in communication with said fuel storage vessel through said exhaust gas opening, wherein said lower portion of said fuel vessel comprises a fuel combustion zone.

2. The furnace according to claim 1 comprising an exhaust channel communicating with said secondary combustion chamber, said fuel storage vessel further comprising a valve for selectively connecting said fuel storage vessel to said exhaust channel.

3. The furnace of claim 2, wherein said fuel storage vessel further comprises a closable refueling lid and wherein said exhaust channel communicates with said fuel storage vessel when said refueling lid is in an opened position.

4. The furnace of claim 3, wherein said refueling lid has both an inner wall which is sealed against said fuel storage vessel and an outer wall which is sealed against an exterior surface of the furnace which is positioned outside the fuel storage vessel, said inner wall and said outer wall defining an exterior gap there between, said exterior gap being in communication with said exhaust channel.

5. The furnace of claim 4, wherein said exterior gap intermediate the interior and exterior continuously communicates with said exhaust channel system, whether said refueling lid is open or closed.

6. The furnace of claim 4, wherein said inner and said outer sealing walls of said refueling lid are movable relative to one another against the action of a spring in order to provide an efficient sealing effect independently of any variations in the spacing between said fuel storage vessel and said exterior surface of said furnace with which the lid cooperates in the closed position.

7. The furnace according to claim 1, wherein said fuel storage vessel and said combustion chamber comprise a ceramics material which is assembled in to a unit.

8. The furnace according to claim 1, wherein said inclined surfaces of said fuel storage vessel comprise removable ceramics slabs the facing bottom edges of which form said burner opening and thus determined the size of the burner opening.

9. The furnace according to claim 1, wherein said draft-air channels which are provided at the upper part of the draft-air supply are covered from above by eaves-like projections.

10. The furnace according to claim 1, wherein said draft-air supply comprises downwardly directed draft air channels which open into said gap and laterally-directed air channels which open into said lower portion of said fuel storage vessel.

11. The furnace according to claim 1, wherein said draft-air supply further comprises means for adjustably controlling a flow of air to said draft-air supply.

* * * * *